US006360725B1

(12) United States Patent
Scherrbacher

(10) Patent No.: US 6,360,725 B1
(45) **Date of Patent: *Mar. 26, 2002**

(54) METHOD AND DEVICE FOR CONTROLLING AN ELECTRO-MAGNETIC LOAD

(75) Inventor: Klaus Scherrbacher, Schwieberdingen (DE)

(73) Assignee: Robert Bosch GmbH, Stuttgart (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/424,212

(22) PCT Filed: Mar. 19, 1999

(86) PCT No.: PCT/DE99/00776

§ 371 Date: Nov. 19, 1999

§ 102(e) Date: Nov. 19, 1999

(87) PCT Pub. No.: WO99/49195

PCT Pub. Date: Sep. 30, 1999

(30) Foreign Application Priority Data

Mar. 25, 1998 (DE) ..... 198 13 138

(51) Int. Cl.[7] ..... F02M 51/00; H01H 47/00
(52) U.S. Cl. ..... 123/490; 361/155
(58) Field of Search ..... 123/490, 478; 361/155, 154, 152, 191, 156

(56) References Cited

U.S. PATENT DOCUMENTS

| | | | | |
|---|---|---|---|---|
| 4,377,144 A | * | 3/1983 | Takahashi | 123/490 |
| 5,442,515 A | * | 8/1995 | Wallaert | 361/187 |
| 5,717,562 A | | 2/1998 | Gihring et al. | |
| 5,937,828 A | * | 8/1999 | Watanabe | 123/490 |

FOREIGN PATENT DOCUMENTS

| | | |
|---|---|---|
| EP | 0 854 281 | 7/1998 |
| GB | 2 305 561 | 4/1997 |

* cited by examiner

*Primary Examiner*—Henry C. Yuen
*Assistant Examiner*—Mahmoud Gimie
(74) *Attorney, Agent, or Firm*—Kenyon & Kenyon

(57) ABSTRACT

A method and device for driving at least one electromagnetic load, in particular a solenoid valve, for controlling an injection of fuel into an internal combustion engine, using a drive circuit equipped with an electronic switching device and at least one booster capacitor. The booster capacitor includes a recharging device that recharges a voltage of the booster capacitor to a desired voltage value influencing an opening speed of the solenoid valve, and thus an injection time, each time the booster capacitor is partially or completely discharged. The recharging device is functionally connected to a detecting device for detecting at least a speed and a load of the internal combustion engine. The recharging device includes a regulating device that regulates an intensity of a recharging current needed for the desired voltage value and the necessary recharging time, at least as a function of the speed and the load detected by the detecting device.

30 Claims, 2 Drawing Sheets

METHOD AND DEVICE FOR CONTROLLING AN ELECTRO-MAGNETIC LOAD

FIELD OF THE INVENTION

The present invention relates to a method and a device for driving at least one electromagnetic load, in particular a solenoid valve, for controlling the injection of fuel into an internal combustion engine, using a drive circuit equipped with electronic switching means and at least one booster capacitor. The booster capacitor has a first step in which voltage of the booster capacitor is recharged to a desired value influencing the opening speed of the injection valve, and thus the injection time, each time the booster capacitor is partially or completely discharged.

BACKGROUND INFORMATION

A method of this type and a device of this type are described in German Patent No. 195 39 071.

In common rail fuel injection systems, fuel mass metering for a cylinder is generally controlled by an injection valve. Metering precision is determined, among other things, by how fast the injection valve opens. The opening speed of the injection valve is accelerated by applying a high voltage, supplied from a booster capacitor, to the injection valve. The booster capacitor voltage must be returned to the desired value after the booster capacitor is completely or partially discharged during injection. This recharging operation is carried out using an electric circuit and takes a certain amount of time. If multiple injections take place in such rapid succession that an insufficient amount of time remains to completely recharge the booster capacitor, an undefined voltage is set at the booster capacitor. The failure of the booster capacitor voltage to return to the desired value at the beginning of injection causes the injection valve to open at different times, thus also producing different fuel masses. The different fuel masses increase exhaust emissions and decreases engine efficiency.

According to the object of German Patent No. 195 39 071 mentioned above, the booster capacitor is charged by selectively activating multiple switching means in a way that accelerates power-on and minimizes overall power consumption. Provided for this purpose are control means which drive the switching means in such a way that at least the power released during the transition from an inrush current value to a holding current value can be stored in the booster capacitor.

SUMMARY OF THE INVENTION

In light of the above remarks, an object of the present invention is to drive an electromagnetic load with sufficiently precise timing to improve, in particular, the fuel metering accuracy in an internal combustion engine having a common rail fuel injection system.

DC/DC converters are also frequently used to charge the booster capacitor.

According to one embodiment, the present invention also minimizes power loss when driving the electromagnetic load.

In a method according to the present invention, the above-mentioned object is achieved by detecting at least one operating state of the internal combustion engine and regulating the intensity of the required recharging current and/or the required recharging time necessary for the booster capacitor, at least as a function of the operating state.

According to an advantageous embodiment of the above method, the intensity of the recharging current and, correspondingly, the recharging time are defined and adjusted to the recharging current during regulation. This step makes it possible to advantageously minimize the power loss.

In situations where multiple injections must take place in rapid succession, for example when switching from stratified charge mode to homogeneous mode during direct gasoline injection or in the case of pre-injection or post-injection (e.g. to regulate the catalytic converter), the normal recharging time is insufficient. If this is required, the method according to the present invention regulates the recharging current intensity and/or the recharging time as a function of these additional engine control requirements.

A further step is to measure the voltage of the booster capacitor and regulate the recharging current and/or recharging time as a function of the measured voltage at the booster capacitor.

Another embodiment allows the calculated injection time to be corrected using a correction value representing the difference between the measured voltage and the desired voltage at the booster capacitor by correcting the calculated injection time with the correction value in a further step, thus forming a corrected injection time.

A device achieving the above object for driving at least one electromagnetic load, in particular a solenoid valve, for controlling the injection of fuel into an internal combustion engine, using a drive circuit equipped with electronic switching means and at least one booster capacitor and having recharging means which recharge the booster capacitor voltage to a desired value is characterized in that the recharging means are functionally connected to means for detecting at least one operating state of the internal combustion engine and have regulating means for regulating the intensity of the recharging current needed for the desired voltage value and/or the necessary recharging time, at least as a function of the operating state of the internal combustion engine detected by the detecting means.

DETAILED DESCRIPTION

Figure 1:
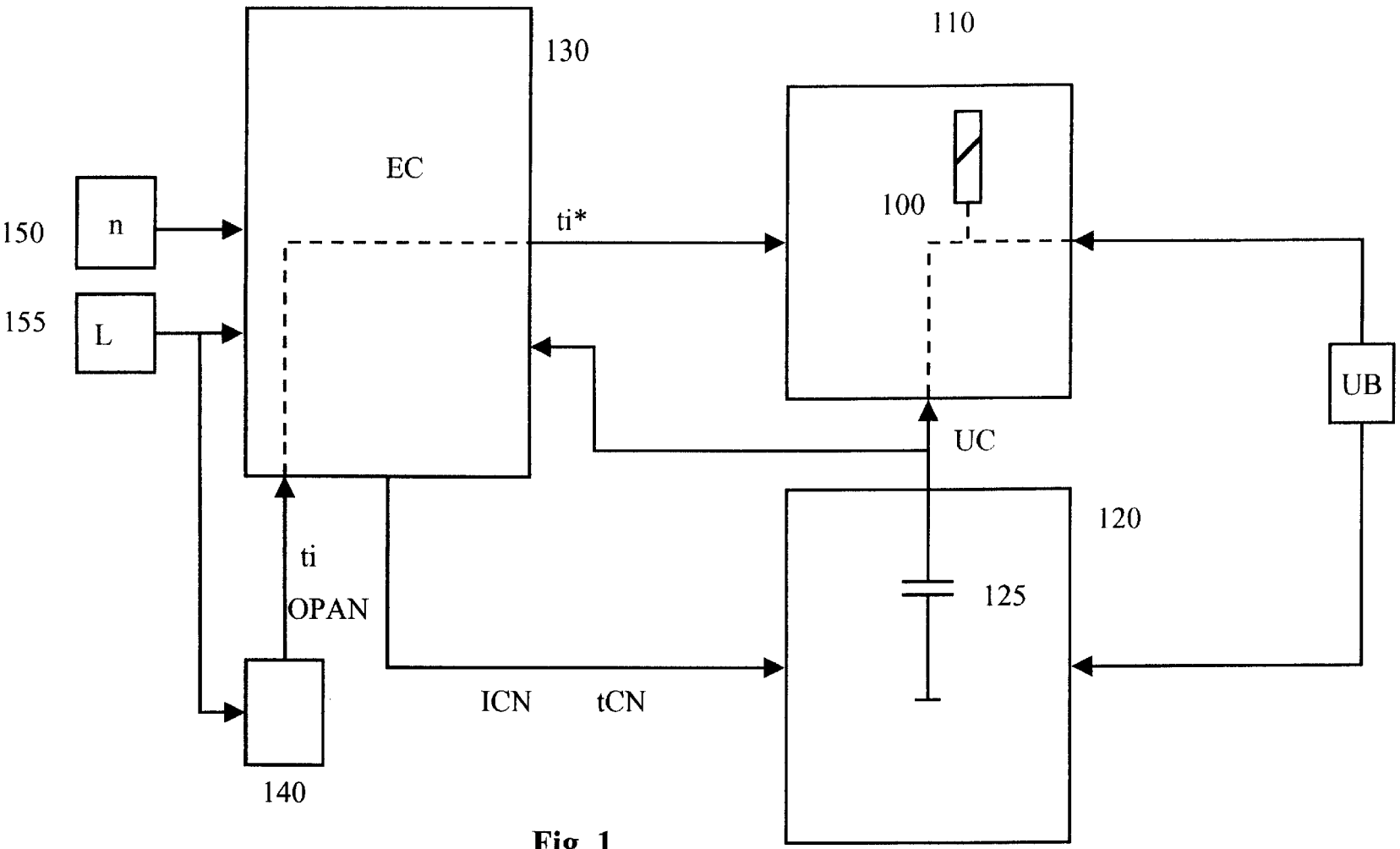
FIG. 1 shows a block diagram of a device according to the present invention.

In FIG. 1, reference number 100 identifies an example of an electromagnetic load. The latter is driven by an output stage identified by reference number 110. Also provided is a charging circuit 120, which has a booster capacitor 125 as its most important element. Output stage 110 and charging circuit 120 can form a structural unit and be designed according to the arrangement described in German Patent No. 195 39 071.

Both output stage 110 and charging circuit 120 are connected to a supply voltage UB. In a motor vehicle, this is preferably the vehicle battery. Booster capacitor 125 is connected to ground as well as to output stage 110. Electromagnetic load 100 can be connected to either voltage UC of booster capacitor 110 or supply voltage UB. This connection is represented by a dash-and-dot line. The booster capacitor is also connected to a control unit EC 130. This control unit 130 applies signals ICN and tCN to the charging circuit. Control unit 130 also applies a signal ti* to the output stage.

Output signals N of a speed sensor 150 and signal L of a load selector 155 are supplied to control unit 130. Control unit 130 also receives output signal ti and output signal OPAN from an engine controller 140. Engine controller 140 processes at least output signal L of load selector 155.

Sensor 150 preferably detects speed n of the internal combustion engine. Load selector 155 supplies a signal L, which identifies the load of the internal combustion engine. This can be an interface to other control units in the motor vehicle. However, load quantity L can also be an internal quantity of engine controller 140. In the case of internal combustion engines with externally supplied ignition, load quantity L is preferably the throttle position. In the case of internal combustion engines with auto-ignition, it can be, for example, a quantity characterizing the volume of fuel to be injected.

Based on at least load quantity L, engine controller 140 determines a drive signal ti which specifies the switching duration of the electromagnetic load. This drive duration ti, which is applied to the output stage, determines the beginning and end of injection. The broken line shows that this signal usually passes from engine controller 140 directly to output stage 110.

As the driving action begins, a voltage that is higher than supply voltage UB is usually applied to electromagnetic load 100. This higher voltage UC is provided by charging circuit 120. Charging circuit 120 can be designed, for example, as a DC/DC converter that converts one DC voltage to a higher DC voltage.

The essential element of this charging circuit is booster capacitor 125. The latter is charged by the charging circuit to a voltage UC that is higher than supply voltage UB. As the driving action begins, this higher voltage is applied to electromagnetic load 100 so that the load responds more quickly.

The charging of booster capacitor 125 is largely determined by recharging current ICN and recharging time tCN. These two quantities are defined by control unit 130 and supplied to charging circuit 120. For this purpose, control unit 130 processes, among other things, voltage UC, which is present at booster capacitor 125. Signal OPAN, which is supplied by the engine controller, is also evaluated. This signal OPAN represents a request from the engine controller, which means that this signal can indicate, for example, the need to switch from a stratified charge mode to a homogeneous mode.

Control unit 130 and charging circuit 120, in particular, are also referred to as recharging means. The operation of the various elements is described in detail below on the basis of FIGS. 2 through 4.

Figure 2:
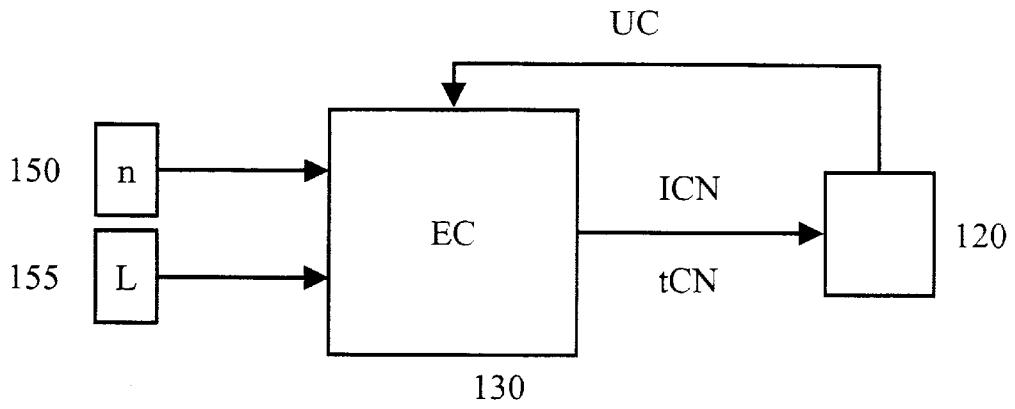
FIG. 2 shows functional features of a first embodiment of a method and device according to the present invention for driving at least one electromagnetic load.
Figure 3:
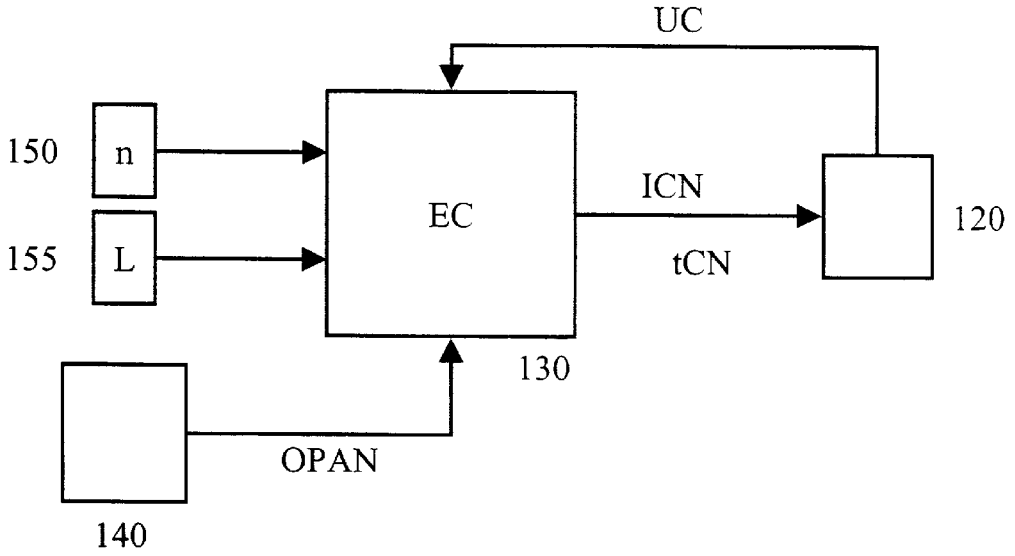
FIG. 3 shows functional features of a second embodiment of a method and device according to the present invention for driving at least one electromagnetic load.
Figure 4:
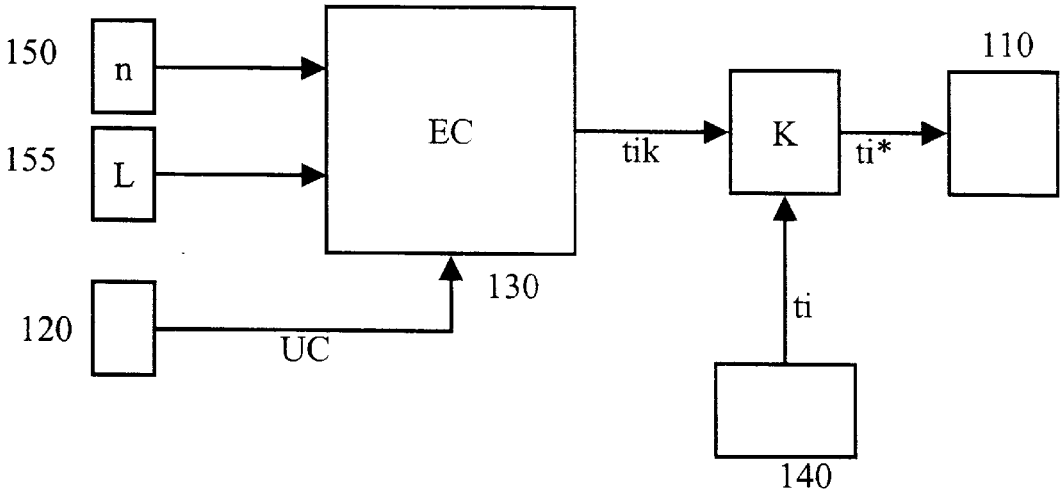
FIG. 4 shows functional features of a third embodiment of a method and device according to the present invention for driving at least one electromagnetic load.

FIGS. 2 through 4 show functional features of three different embodiments of the method and device according to the present invention for driving at least one electromagnetic load, and these three embodiments, which are described below, can also be combined. In addition, note that the output stage known from German Patent No. 195 39 071 mentioned above can also be used for the drive device according to the present invention.

As shown in FIG. 2, voltage UC at the booster capacitor, speed n and/or load L of the internal combustion engine are detected. As a function of detected quantities UC, n, and/or L, electronic control unit EC regulates the intensity of recharging current ICN as well as recharging time tCN for recharging the booster capacitor. Voltage UC is measured prior to injection. To minimize the power loss, recharging current ICN can be varied as a function of the speed/load range. This means that recharging time tCN must also be varied. A drop in recharging current ICN prolongs recharging time tCN, at the same time reducing the power loss.

In this case, it is not absolutely necessary to measure voltage UC of the booster capacitor if the variations in recharging current and recharging time are adjusted to one another.

As shown in FIG. 3, certain requests OPAN from the engine controller are detected in addition to the detection of voltage UC at the booster capacitor, speed n, and load L. Such requests may include, in particular, the need to perform multiple injections in rapid succession, such as when switching from stratified charge mode to homogeneous mode during direct gasoline injection or when performing pre-injections or post-injection, e.g. for regenerating the catalytic converter. In this case, the normal recharging time is insufficient. If such a request is made, electronic control/regulating unit EC can briefly increase recharging current ICN, thus shortening recharging time tCN, so that desired booster capacitor voltage UC continues to be applied, thus ensuring accurate fuel metering. If a limited number of recharging operations is necessary, it is possible to briefly overload the charging circuit.

In this case as well, it is not absolutely necessary to measure voltage UC prior to injection if the variations in recharging current ICN and recharging time tCN are adjusted to one another.

In the embodiment illustrated in FIG. 4, voltage UC at the booster capacitor, speed n, and load value L of the internal combustion engine are detected and corresponding quantities supplied to electronic control/regulating unit EC. The latter forms a correction value tik for correcting calculated injection time ti. A correction element K links calculated injection time ti with correction value tik, thus forming a corrected injection time ti*. Correction means K can, of course, also be part of electronic control/regulating unit EC.

According to the present invention, the booster capacitor voltage is recharged to a desired value in a first step. The booster capacitor voltage is preferably recharged to a desired value influencing the opening speed of the injection valve, and thus the injection time, each time the booster capacitor is partially or completely discharged.

At least one operating state of the internal combustion engine is detected in a second step. The speed and the load of the internal combustion engine are preferably detected. It is advantageous to also detect certain requests from the engine controller. These requests may include, for example a signal OPAN indicating that the same solenoid valve needs to perform multiple injections in very short intervals. It is also possible to measure the voltage at the booster capacitor, in particular, prior to injection.

In a third step, intensity ICN of the recharging current needed in the first step and/or necessary recharging time tCN for the booster capacitor are regulated at least as a function of the operating state detected in the second step.

It is also advantageous to adjust the recharging current intensity and the recharging time to one another during regulation in the third step and to regulate the intensity of recharging current ICN and/or recharging time tCN as a function of the requests from the engine controller additionally detected in the second step. These additionally detected requests from the engine controller concern, in particular, the switching from stratified charge mode to homogeneous mode and/or the division of the injection into multiple partial injections, such as pre-injections and/or post-injections.

It is especially advantageous to determine a correction value (tik) which represents a difference between the measured voltage and the desired booster capacitor voltage value when driving the fuel injectors, based on the voltage measured at the booster capacitor in the second step.

According to a further embodiment, a calculated injection time (ti) for the fuel injectors is corrected with correction value (tik) in a fifth step, thus forming a corrected injection time (ti*).

It is clear that the embodiments of the present invention illustrated in FIGS. 2 through 4 and described above can also be combined with each other. The means used for recharging, or the recharging means, and the regulating means can be hardware or software components belonging to or used in connection with electronic control/regulating unit EC. Electronic control/regulating unit EC can be provided specifically for the object of the present invention, or it can form part of a control/regulating unit already existing in the motor vehicle. With the help of the features according to the present invention, recharging of the booster capacitor can be controlled by selectively varying recharging current ICN and/or recharging time tCN specifically to optimize the power loss; and this can be accomplished in the case of certain requests from the engine controller that require multiple injections in very short intervals, such as switching from stratified charge mode to homogeneous mode, pre-injection, and post-injection.

It is also possible to correct injection time ti* as a function of the booster capacitor voltage, the load range, and/or the speed range of the internal combustion engine.

What is claimed is:

1. A method for driving at least one electromagnetic load for controlling an injection of fuel into an internal combustion engine, the method using a drive circuit including an electronic switching device and at least one booster capacitor, the at least one electromagnetic load including a solenoid valve, comprising the steps of:

in a first step, recharging a first voltage of the booster capacitor to a desired voltage value;

in a second step, detecting at least one operating state of the internal combustion engine and detecting requests from an engine controller, the requests requiring the solenoid valve to perform multiple injections in very short intervals; and in a third step, regulating, at least as a function of the detected at least one operating state and the requests from the engine controller, at least one of:

an intensity of a recharging current used in the first step, and a necessary recharging time for the booster capacitor.

2. The method according to claim 1, wherein the third step includes the substep of:

adjusting the intensity of the recharging current and the recharging time to one another.

3. The method according to claim 1, wherein the requests concern switching from a stratified charge mode to a homogenous mode and at least one of pre-injections and post-injections.

4. The method according to claim 1, further comprising the step of:

measuring a second voltage of the booster capacitor prior to injection in the second step.

5. The method according to claim 4, wherein the third step includes the substep of:

regulating the intensity of the recharging current and the recharging time as a function of the second voltage.

6. The method according to claim 4, further comprising the steps of:

in a fourth step, determining a correction value for an injection time, the correction value representing a difference between the second voltage and the desired voltage value; and in a fifth step, correcting a calculated injection time with the correction value to form a corrected injection time.

7. A method for driving at least one electromagnetic load for controlling an injection of fuel into an internal combustion engine, the method using a drive circuit including an electronic switching device and at least one booster capacitor, the at least one electromagnetic load including a solenoid valve, comprising the steps of:

in a first step, recharging a first voltage of the booster capacitor to a desired voltage value, the first voltage influencing an opening speed and an injection time of the solenoid valve each time the booster capacitor is at least partially discharged;

in a second step, detecting at least a speed and a load of the internal combustion engine;

in a third step, regulating an intensity of a recharging current used in the first step and a necessary recharging time for the booster capacitor at least as a function of the speed and the load.

8. A device for driving at least one electromagnetic load for controlling an injection of fuel into an internal combustion engine, the at least one electromagnetic load including a solenoid valve, comprising:

a drive circuit including an electronic switching device and at least one booster capacitor;

a first detecting device detecting at least one operating state of the internal combustion engine; and a recharging device recharging a voltage of the booster capacitor to a desired voltage value, the recharging device being functionally coupled to the first detecting device, the recharging device including a regulating device regulating an intensity of a recharging current needed for at least one of the desired voltage value and a necessary recharging time at least as a function of the detected operating state;

the recharging device being functionally coupled to a second detecting device, the second detecting device detecting requests from an engine controller, the requests requiring the solenoid valve to perform multiple injections in very short intervals, and the regulating device regulating the intensity of the recharging current and the recharging time as a function of the requests from the engine controller.

9. The device according to claim 8, wherein the regulating device synchronizes the intensity of the recharging current needed to obtain the desired voltage value and the necessary recharging time.

10. The device according to claim 8, wherein the requests concern switching from a stratified charge mode to a homogeneous mode and at least one of pre-injections by the solenoid valve and post-injections by the solenoid valve.

11. The device according to claim 10, further comprising:

a measuring device measuring a second voltage present at the booster capacitor prior to injection, the measuring device supplying a quantity to the regulating device, the quantity corresponding to the second voltage.

12. The device according to claim 11, wherein the regulating device also regulates the recharging current and the recharging time as a function of the quantity corresponding to the second voltage.

13. The device according to claim 8, further comprising:

a correction device forming a correction value for an injection time, the correction value representing a difference between a second voltage present at the booster capacitor and the desired voltage value, the correction device correcting a calculated injection time with the correction value to form a corrected injection time.

14. A device for driving at least one electromagnetic load for controlling an injection of fuel into an internal combustion engine, the at least one electromagnetic load including a solenoid valve, comprising:

a drive circuit including an electronic switching device and at least one booster capacitor;

a detecting device detecting at least a speed and a load of the internal combustion engine; and a recharging device recharging a voltage of the booster capacitor to a desired voltage value, the recharging device being functionally coupled to the detecting device, the recharging device influencing an opening speed and an injection time of the solenoid valve each time the booster capacitor is at least partially discharged, the recharging device including a regulating device regulating:

an intensity of a recharging current needed for the desired voltage value, and a necessary recharging time, at least as a function of the speed and the load.

15. A device for driving at least one electromagnetic load for controlling an injection of fuel into an internal combustion engine, the at least one electromagnetic load including a solenoid valve, comprising:

a drive circuit electronic switching and booster capacitor;

means for detecting at least one operating state of the internal combustion engine;

means for recharging a voltage of the at least one booster capacitor to a desired voltage value; and means for regulating an intensity of a recharging current needed for at least one of the desired voltage value and a necessary recharging time at least based on the detected operating state.

16. The device according to claim 15, wherein the means for regulating synchronizes the intensity of the recharging current for obtaining the desired voltage value and the necessary recharging time.

17. The device according to claim 15, further comprising means for measuring a second voltage present at the at least one booster capacitor prior to injection, and for supplying a quantity corresponding to the second voltage to the means for regulating;

wherein:

the means for recharging is coupled to means for detecting requests from an engine controller, the requests requiring the solenoid valve to perform multiple injections at intervals;

the means for regulating is operable to regulate the intensity of the recharging current and the recharging time based on the requests from the engine controller and the quantity corresponding to the second voltage; and the requests concern switching from a stratified charge mode to a homogeneous mode, and concern at least one of pre-injections and post-injections by the solenoid valve.

18. A device for driving at least one electromagnetic load for controlling an injection of fuel into an internal combustion engine, the at least one electromagnetic load including a solenoid valve, comprising:

a drive circuit including an electronic switching device and at least one booster capacitor;

means for detecting at least a speed and a load of the internal combustion engine;

means for recharging a voltage of the at least one booster capacitor to a desired voltage value, and for influencing an opening speed and an injection time of the solenoid valve when the at least one booster capacitor is at least partially discharged; and means for regulating an intensity of a recharging current needed for the desired voltage value and a necessary recharging time at least based on the speed and the load.

19. A method for driving at least one electromagnetic load for controlling an injection of fuel into an internal combustion engine, the method using a drive circuit including an electronic switching device and at least one booster capacitor, the at least one electromagnetic load including a solenoid valve, comprising the steps of:

in a first step, recharging a first voltage of the booster capacitor to a desired voltage value, the first voltage influencing an opening speed and an injection time of the solenoid valve each time the booster capacitor is at least partially discharged;

in a second step, detecting at least one operating state of the internal combustion engine, the at least one operating state including at least one of a speed and a load, and detecting requests from an engine controller, the requests requiring the solenoid valve to perform multiple injections in very short intervals;

in a third step, regulating at least one of:

an intensity of a recharging current used in the first step, and a necessary recharging time for the booster capacitor, as a function of at least one of the at least one operating state and the requests from the engine controller.

20. The method according to claim 19, wherein the third step includes the substep of:

adjusting the intensity of the recharging current and the recharging time to one another.

21. The method according to claim 19, wherein the requests concern switching from a stratified charge mode to a homogenous mode and at least one of pre-injections and post-injections.

22. The method according to claim 19, further comprising the step of:

measuring a second voltage of the booster capacitor prior to injection in the second step.

23. The method according to claim 22, wherein the third step includes the substep of:

regulating the intensity of the recharging current and the recharging time as a function of the second voltage.

24. The method according to claim 22, further comprising the steps of:

in a fourth step, determining a correction value for an injection time, the correction value representing a difference between the second voltage and the desired voltage value; and in a fifth step, correcting a calculated injection time with the correction value to form a corrected injection time.

25. A device for driving at least one electromagnetic load for controlling an injection of fuel into an internal combustion engine, the at least one electromagnetic load including a solenoid valve, comprising:

a drive circuit including an electronic switching device and at least one booster capacitor;

a first detecting device detecting at least one operating state of the internal combustion engine, the at least one operating state including at least one of a speed and a load; and a recharging device for recharging a voltage of the booster capacitor to a desired voltage value, the recharging device being functionally coupled to the first detecting device, wherein the recharging device is functionally coupled to a second detecting device, the second detection device detecting requests from an engine controller, the requests requiring the solenoid valve to perform multiple injections in very short intervals, the recharging device influencing an opening speed and an injection time of the solenoid valve each time the booster capacitor is at least partially discharged, the recharging device including a regulating device for regulating:

an intensity of a recharging current needed for at least one of the desired voltage value, and a necessary recharging time, at least as a function of at least one of the at least one operating state and the requests from the engine controller.

26. The device according to claim 25, wherein the regulating device is for synchronizing the intensity of the recharging current needed to obtain the desired voltage value and the necessary recharging time.

27. The device according to claim 25, wherein the requests concern switching from a stratified charge mode to a homogeneous mode and at least one of pre-injections by the solenoid valve and post-injections by the solenoid valve.

28. The device according to claim 27, further comprising:

a measuring device for measuring a second voltage present at the booster capacitor prior to injection, and for supplying a quantity to the regulating device, the quantity corresponding to the second voltage.

29. The device according to claim 28, wherein the regulating device is also for regulating the recharging current and the recharging time as a function of the quantity corresponding to the second voltage.

30. The device according to claim 25, further comprising:

a correction device for forming a correction value for an injection time, the correction value representing a difference between a second voltage present at the booster capacitor and the desired voltage value, the correction device correcting a calculated injection time with the correction value to form a corrected injection time.

* * * * *